United States Patent [19]

Fagnant

[11] Patent Number: 4,723,717

[45] Date of Patent: Feb. 9, 1988

[54] ROTARY SHEARING/CUTTING MACHINE

[75] Inventor: Norman A. Fagnant, Mendon, Mass.

[73] Assignee: Nelmor Co., Inc., North Uxbridge, Mass.

[21] Appl. No.: 408,514

[22] Filed: Aug. 16, 1982

[51] Int. Cl.[4] ..... B02C 18/22

[52] U.S. Cl. ..... 241/222; 241/236; 241/280; 241/293

[58] Field of Search ..... 241/222, 224, 229, 236, 241/293, 294, 295, 297, 280, 282, 187, 190; 366/297, 298, 300, 301

[56] References Cited

U.S. PATENT DOCUMENTS

| | | | |
|---|---|---|---|
| 1,608,183 | 11/1926 | Quante | 241/222 X |
| 2,918,224 | 12/1959 | Hornberger | 241/282 |
| 3,664,592 | 5/1972 | Schweigert et al. | 241/236 |
| 3,845,907 | 11/1974 | Schwarz | 241/236 X |
| 4,165,043 | 8/1979 | Higashi et al. | 241/236 |

FOREIGN PATENT DOCUMENTS

| | | | |
|---|---|---|---|
| 1148697 | 5/1963 | Fed. Rep. of Germany | 241/229 |
| 580543 | 4/1924 | France | 241/187 |
| 423604 | 9/1948 | Italy | 241/224 |
| 2091128 | 7/1982 | United Kingdom | 241/236 |
| 633601 | 11/1978 | U.S.S.R. | 241/236 |

*Primary Examiner*—P. W. Echols
*Assistant Examiner*—Joseph M. Gorski
*Attorney, Agent, or Firm*—Kinzer, Plyer, Dorn, McEachran & Jambor

[57] ABSTRACT

A rotary shearing/cutting machine, capable of comminuting article of many diverse materials and widely varying dimensional characteristics (i.e., plastic barrels and other containers, plastic and metal films, rubber tires, etc.) has four rotary driven shafts extending across a comminution chamber in parallel spaced relation to each other, with two center shafts rotating in opposite directions and with the shafts rotating at different speeds; a series of primary shear blades interspersed one-for-one with a series of secondary cutter blades are mounted on each shaft for rotation therewith, each shear blade projecting into the space between the shear blades on any adjacent shaft in close overlapping proximity thereto. Each shear blade and each cutter blade is of disc-like configuration having at least one radially projecting C-shaped cutting element affording a transverse cutting edge facing in the direction of rotation; the cutter blades are substantially smaller in diameter than the shear blades. The radial faces of the shear blades are recessed to afford annular expansion spaces for material sheared in the regions of overlap of the shear blades, materially reducing the power requirements for the machine and minimizing the possibility of jamming of the machine. A power feed forces articles to be comminuted along a feed chute into the inlet opening of the comminution chamber.

10 Claims, 7 Drawing Figures

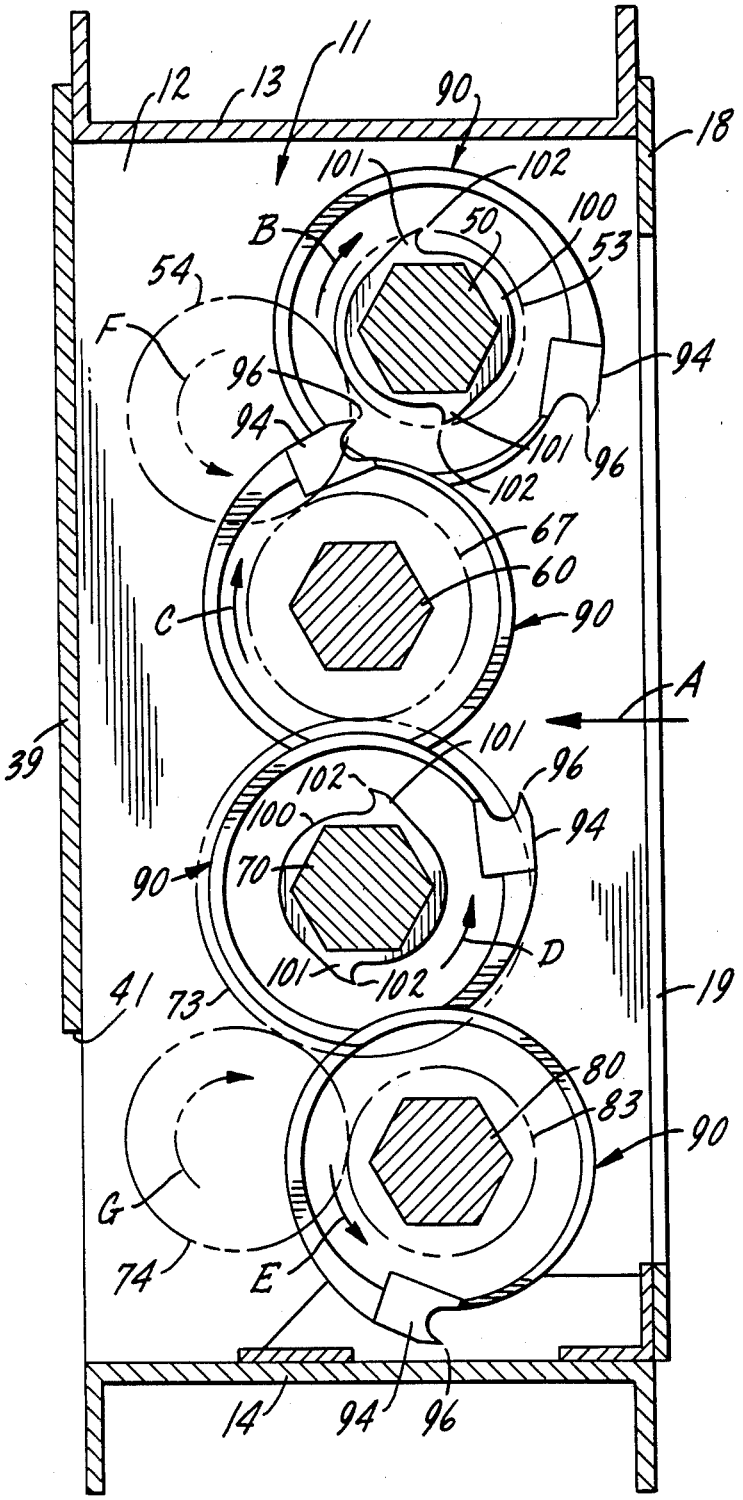
Fig. 3.
Fig. 7.
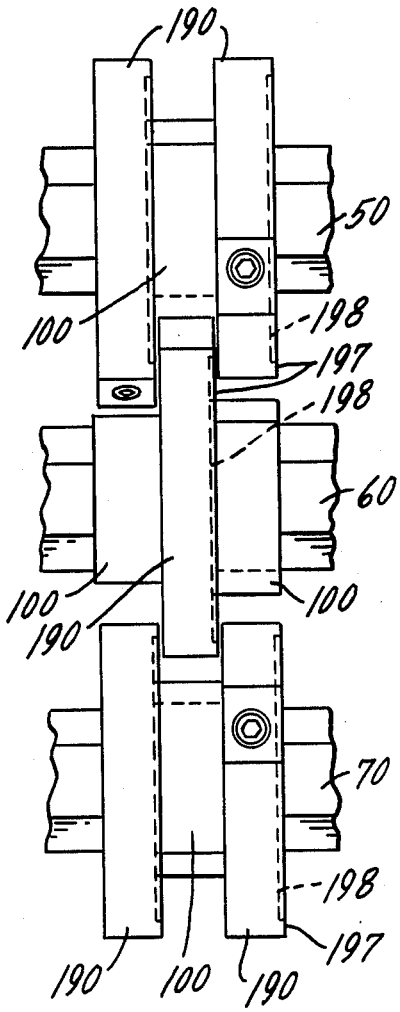

ROTARY SHEARING/CUTTING MACHINE

BACKGROUND OF THE INVENTION

It is often necessary to cut, shear, shred, or otherwise comminute different objects and articles for disposal purposes and, in some instances, for possible re-use. Thus, in a thermoplastic molding operation sprues, runners, and defective molded articles are commonly reduced to granular form for re-use. Another common requirement of this kind pertains to plastic barrels and other containers, and plastic pipe, which are comminuted to facilitate disposal. Yet another such application is in the reduction of used rubber tires to a form suitable for convenient and effective disposal.

One type of comminuting machine that has been generally successful in a variety of applications is disclosed, in an early version, in Schweigert et al U.S. Pat. No. 3,664,592 issued May 23, 1972; a later version of a similar machine is described in Schwarz U.S. Pat. No. 3,880,361 issued Apr. 29, 1975. In the machines disclosed in these two patents, the articles to be comminuted are fed by gravity, through an input hopper, into a comminuting chamber through which two horizontal rotary shafts extend in parallel relation to each other. A series of disc-shaped cutting blades is mounted on and rotated by each of the shafts, with each blade projecting into the space between blades on the adjacent shaft in close overlapping proximity thereto. Each blade has at least one radially projecting C-shaped cutting element affording a transverse cutting edge facing in the direction of rotation of its shaft, the two shafts being counter-rotated relative to each other. The rotating blades cut and shear articles fed into the machine, reducing them to pieces having a size suitable for convenient disposal or, in some instances for further granulation to particle sizes suitable for re-use.

Although the comminuting machines described in the aforementioned Schweigert et al and Schwarz patents are more effective and efficient than other such machines known in the art, there are nevertheless some substantial remaining problems. One major problem is the high power requirements for machines of this kind, resulting from high friction forces developed when large objects are cut and sheared and passed between the rotating blades. A related problem is frequent jamming of the machines. These problems can sometimes be alleviated by providing increased spacing between the overlapping areas of the blades on the adjacent shafts. However, this is not always effective because it tends to reduce the cutting/shearing action of the overlapping blades and is also undesirable because it may permit thin sections of the articles being comminuted to pass through the machine without adequate size reduction.

Another difficulty associated with machines of this kind results from inconsistent feeding of the articles to be comminuted into the operating chambers of the machines. Thus, for lightweight objects of substantial volume, such as plastic containers, gravity feed may be inadequate. Yet another appreciable problem in these machines results from the fact that the shearing action frequently produces long streamers from the articles being comminuted instead of the relatively small and compact pieces desired.

SUMMARY OF THE INVENTION

It is a principal object of the present invention, therefore, to provide a new and improved rotary shearing/cutting machine, capable of comminuting articles of many diverse materials and widely varying dimensional characteristics, in which the friction forces on the rotary shearing/cutting blades of the machine are materially reduced, with a consequent reduction in power requirements for the main drive of the machine.

A further object of the invention is to provide a new and improved rotary shearing/cutting machine for comminuting articles of widely varying dimensional characteristics formed of a broad range of different materials that effectively cuts any long streamers resulting from the initial shearing action of the machine into shorter lengths.

Another object of the present invention is to provide a new and improved rotary shearing/cutting machine adapted to the comminution of articles of diverse materials and widely varying dimensional characteristics that incorporates an effective and efficient power feed mechanism for impelling objects to be comminuted into the machine to thereby improve the consistency of machine operation.

A specific object of the invention is to provide a new and improved rotary shearing/cutting machine capable of comminuting such diverse articles as plastic barrels and other containers, plastic and metal films, rubber tires, pallets, and the like, that is simple and inexpensive in construction yet highly efficient in operation.

Accordingly, the invention relates to a rotary shearing/cutting machine capable of comminuting articles of widely varying dimensional characteristics formed of a broad variety of different materials, comprising a comminution chamber having an input opening and a discharge opening, feed means for feeding articles to be comminuted into the input opening of the comminution chamber, a plurality of rotary shafts extending across the comminution chamber in paralel spaced relation to each other, and drive means for rotating said shafts. A series of primary shear blades are mounted at spaced locations along each shaft for rotation therewith, each shear blade on one shaft being aligned with and projecting partly into the space between the shear blades on any adjacent shaft in close overlapping proximity thereto. Each shear blade is of generally disc-like configuration and has a C-shaped cutting element projecting radially outwardly therefrom, the cutting element affording a transverse cutting edge facing toward the direction of rotation of the shaft on which the blade is mounted. At least one radial face of each shear blade is recessed, from a point near the rim of the blade for a substantial distance radially inwardly toward the shaft on which the blade is mounted, to afford an annular expansion space for material sheared in the region of overlap between that shear blade and any shear blade on an adjacent shaft.

In the preferred construction for the invention, a series of secondary cutter blades is mounted at spaced locations along each shaft for rotation therewith, each cutter blade being interposed between two adjacent shear blades on the shaft. Each cutter blade is of generally disclike configuration and has a C-shaped cutting element projecting radially outwardly therefrom, affording a transverse cutting edge facing in the direction of rotation of the shaft on which the cutter blade is mounted.

BRIEF DESCRIPTION OF THE DRAWINGS

FIG. 3 is a sectional view taken approximately as indicated by line 3—3 in FIG. 2;

FIG. 7 is a detail view illustrating a modification for the shear blades in the machine of FIGS. 1-6.

DESCRIPTION OF THE PREFERRED EMBODIMENTS

Figure 1:
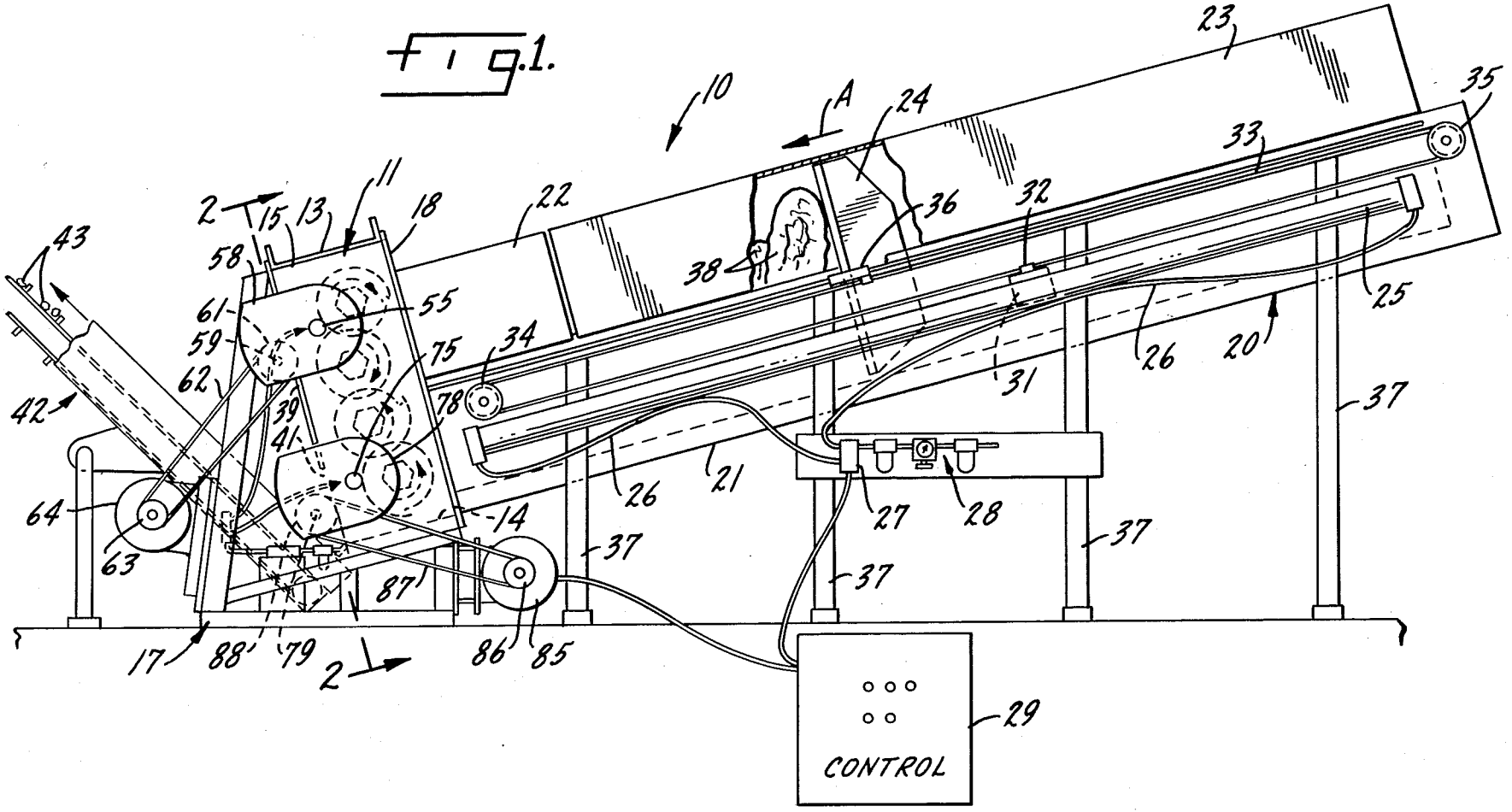
FIG. 1 is a partly schematic side elevation view of a rotary shearing/cutting machine constructed in accordance with a preferred embodiment of the invention.
Figures 4, 5, 6:
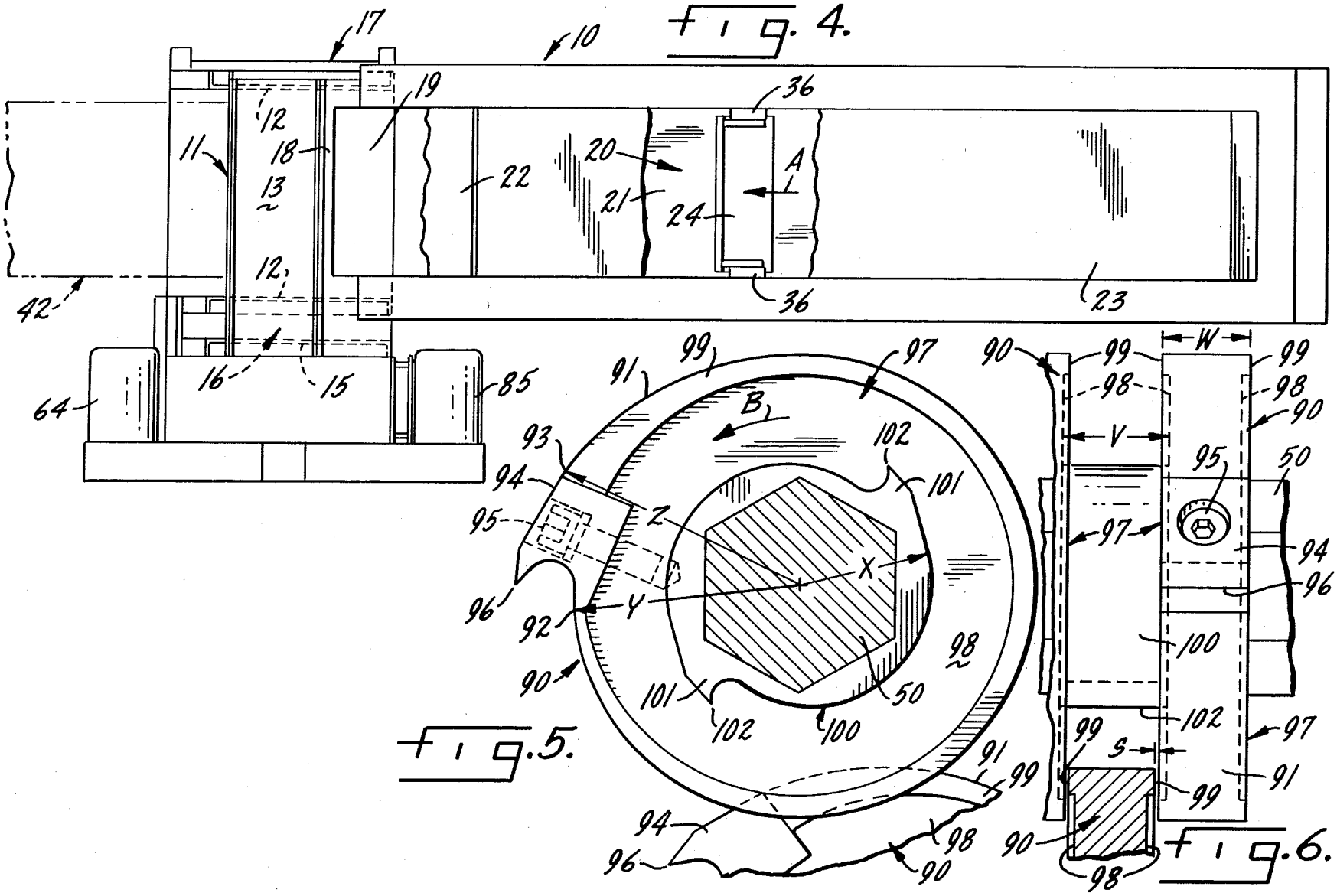
FIG. 4 is a simplified plan view of the machine of FIG. 1.
FIG. 5 is a detail sectional view, on an enlarged scale, illustrating the alignment and relationship of shear blades and cutter blades in the machine of FIGS. 1-4.
FIG. 6 is a detail view on the same scale as FIG. 5, further illustrating the inter-relationship between shear blades and cutter blades in the machine of FIGS. 1-4.

FIGS. 1 and 4 afford general illustrations of a rotary shearing/cutting machine 10, capable of comminuting articles of many diverse materials and widely varying dimensional characteristics such as molded plastic articles, including plastic barrels and other containers, plastic, elastomer, and metal films, rubber tires, pallets, and the like. Machine 10 comprises a comminution chamber 11 of rectangular configuration having side walls 12, a top wall 13, and a bottom wall 14. The near side of comminution chamber 11, as seen in FIGS. 1 and 4, is extended to form a gear chamber 16 having an outer side wall 15. Comminution chamber 11, with its attached gear chamber 16, is mounted on a fixed frame generally indicated by reference number 17. The overall rectangular configuration, essentially square, of comminution chamber 11 is more apparent in FIG. 2.

As best shown in FIG. 4, the front wall 18 for comminution chamber 11 and gear chamber 16 affords a large rectangular input opening 19. Input opening 19 is positioned at one end of a feed mechanism 20 for feeding articles to be comminuted into the comminution chamber 11 of machine 10. The feed mechanism 20 comprises an elongated U-shaped trough or chute 21. The end of chute 21 adjacent the input opening 19 to comminution chamber 11 is covered by a relatively short fixed safety hood 22. The remaining length of chute 21 is enclosed by a hinged safety cover 23. A ram 24 is mounted in chute 21 and extends upwardly into the space enclosed by cover 23 and hood 22.

As shown in FIG. 1, an elongated rodless pneumatic cylinder 25 is mounted alongside chute 21, extending longitudinally of the chute. The opposite ends of cylinder 25 are connected by air lines 26 to a control valve 27 in turn connected to an air compressor (not shown) by a suitable filter and pressure regulation mechanism 28. Valve 27 is connected to a machine control mechanism 29.

A piston 31 in cylinder 25 is connected, through an elongated seal of conventional construction (not shown) and an external connector 32, to a drive chain 33 that extends around two sprockets 34 and 35 located at opposite ends of chute 21. Another connector 36 affixed to chain 33 is utilized to connect the drive chain to ram 24. The portion of the feed mechanism 20 comprising chain 33, sprockets 34 and 35, and connector 36 is preferably duplicated on the opposite side of machine 10 from that shown in FIG. 1 in order to afford a balanced drive for ram 24.

As shown in FIG. 1, comminution chamber 11 is supported on frame 17 with the front wall 18 (and hence the input opening 19) aligned at an acute angle to the vertical. The chute 21 of feed mechanism 20, on the other hand, is supported on a series of legs 37 of progressively increasing height, away from chamber 11, so that the end of chute 21 farthest from chamber 11 is elevated above the bottom of the input opening to the chamber. This increases the effectiveness of ram 24 in moving objects 38 that are to be comminuted along chute 21 and into comminution chamber 11; at the same time, the generally vertical alignment of chamber 11 and horizontal orientation of chute 21 provide for a large capacity of the chute in a machine of limited height. The direction of movement of articles 38 along chute 21 is indicated by arrow A in FIGS. 1 and 4.

There is a rear wall 39 on comminution chamber 11 (FIG. 1) that is terminated a substantial distance above the bottom wall 14 of that chamber, leaving an outlet opening 41 for the chamber. The outlet opening of chamber 41 is aligned with a conventional take-away conveyor 42 for removing comminuted material 43 from machine 10. Conveyor 42 is of conventional construction and requires no further description here. Conveyor 42 may lead to a granulator employed to further reduce the size of the comminuted material 43.

Figure 2:
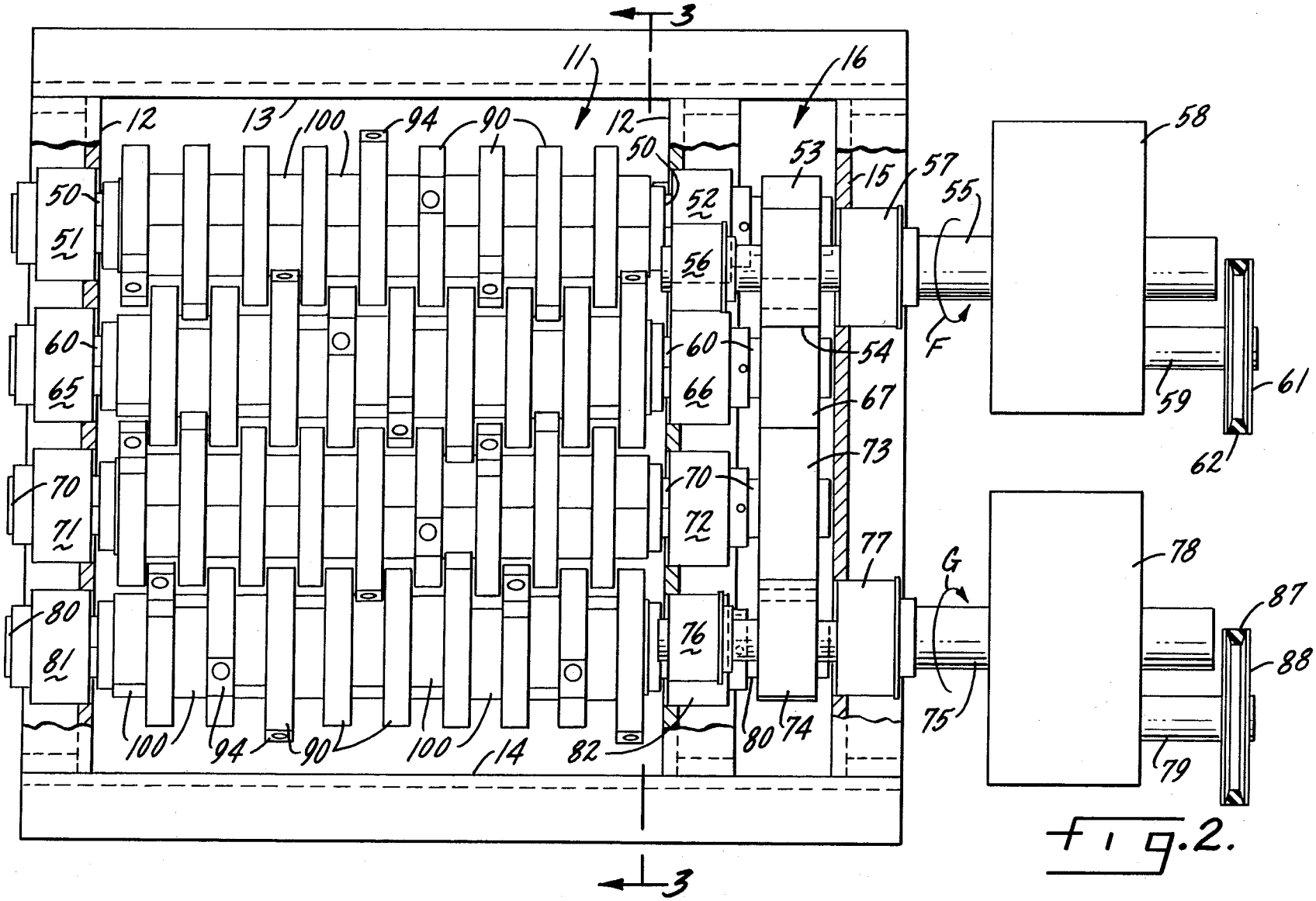
FIG. 2 is a sectional elevation view taken approximately as indicated by line 2—2 in FIG. 1.

The construction and arrangement of the rotary shearing and cutting mechanism mounted within comminution chamber 11 is best illustrated in FIGS. 2 and 3, with additional reference to FIG. 1. As shown in FIGS. 2 and 3, a first shaft 50 extends horizontally across comminution chamber 11, the ends of the shaft being journalled in suitable bearings 51 and 52 mounted in the chamber side walls 12. Shaft 50 extends through bearing 52 and carries a spur gear 53 aligned in meshing engagement with a drive gear 54 mounted on a drive shaft 55 journalled in bearings 56 and 57. Shaft 55 is the output shaft of a gear reducer 58 having an input shaft 59. A pulley 61 mounted on shaft 59 engages a drive belt 62 that also engages a pulley 63 mounted on the shaft of a main comminution drive motor 64.

A second shaft 60 is mounted in comminution chamber 11 with the axis of the shaft extending horizontally across the chamber, parallel to shaft 50. Shaft 60 is supported in bearings 65 and 66 mounted in the two side chamber walls 12 (FIG. 2). Shaft 60 extends beyond bearing 66 and a spur gear 67 is mounted on the outboard end of the shaft, in meshing engagement with drive gear 54.

Comminution chamber 11 also includes a third shaft 70 positioned immediately below shaft 60 and aligned in parallel relation therewith. Shaft 70 is journalled in two bearings 71 and 72 that are mounted in the side walls 12 of the comminution chamber. Shaft 70 extends outwardly of bearing 72 and a spur gear 73 is mounted on the extension of the shaft. Gear 73 is aligned in meshing engagement with a drive gear 74 affixed to the output shaft 75 of a speed reducer 78; shaft 75 is journalled in two bearings 76 and 77. The input shaft 79 of gear reducer 78 has a drive connection to a second main comminution drive motor 85 through a pulley 86, a belt 87, and another pulley 88 as shown in FIGS. 1 and 2.

A fourth horizontal shaft 80 extends across the bottom of comminution chamber 11. Shaft 80 is journalled in bearings 81 and 82 mounted in the comminution chamber side walls 12. The right hand end of shaft 80, as seen in FIG. 2, carries a spur gear 83 aligned in meshing engagement with the drive gear 74. In FIG. 2 gear 83 is masked by gear 74 but the position of gear 83 can best be seen in FIG. 3.

A series of primary shear blades 90 are mounted at spaced locations along shaft 50, as shown in FIG. 2. The portion of shaft 50 on which the shear blades 90 are mounted is of hexagonal cross-sectional configuration, and the central apertures in the shear blades are of the same configuration, so that each primary shear blade is rotated with the shaft. Another series of primary shear blades 90 is similarly mounted on shaft 60 at spaced locations along that shaft, with each shear blade 90 on shaft 60 being aligned with and projecting partly into the space between the shear blades on shaft 50 in close overlapping proximity thereto. Of course, the shear blades 90 on shaft 50 also project into the spaces between the blades 90 on shaft 60, again in close overlapping proximity. In the same manner, a series of the shear blades 90 is mounted on shaft 70 for rotation therewith and yet another series of shear blades 90 is mounted on shaft 80. In each instance, each shear blade 90 on any given shaft is aligned with and projects partly into the space between the shear blades on any adjacent shaft in close overlapping proximity to those blades. In a preferred construction, the spacing between the overlapping shear blades, on each side, is approximately 0.06 inch.

The construction of shear blades 90, which are the same throughout comminution chamber 11, is best illustrated in FIGS. 5 and 6. Each shear blade 90 is of generally disc-like configuration, the peripheral surface 91 being formed as a series of blended arcs and having a minimum radius at point 92 and a maximum radius at point 93. Between points 92 and 93, a cutter insert 94 is mounted in the shear blade by suitable means such as a bolt 95. Insert 94 is of generally C-shaped configuration, comprising a cutting element that projects radially outwardly from shear blade 90 and affording a transverse cutting edge 96 facing in the direction of rotation of shaft 50, indicated in FIG. 5 by arrow B.

Unlike the cutting or shearing blades used in prior art machines generally similar to machine 10, the opposed radial faces 97 of the shear blade discs are not flat. Instead, each of the radial faces 97 of each shear blade 90 is cut away to form a recess 98 that extends from a point near the peripheral rim of the blade inwardly to the point of engagement of the blade with its shaft, in this instance the shaft 50. This leaves a relatively short shearing edge 99 extending completely around blade 90, from one end of insert 94 to the other.

Referring again to FIG. 2, it is seen that a series of secondary cutter blades 100 is mounted at spaced locations along shaft 50, each cutter blade 100 being interposed between two adjacent shear blades 90 on that shaft. Similarly, there is a series of secondary cutter blades 100 mounted at spaced locations along each of the other shafts 60, 70, and 80. On each shaft there is a secondary cutter blade 100 interposed between each adjacent pair of shear blades 90.

As best shown in FIGS. 5 and 6, each secondary cutter blade 100 is of generally disc-like configuration and has a pair of generally C-shaped cutting elements 101 projecting radially outwardly from the blade. The cutting elements 101 each afford a transverse cutting edge 102 facing in the direction of rotation of the shaft on which the cutter blade is mounted (arrow B in FIG. 5). As shown in FIG. 6, each secondary cutter blade 100 extends into the recesses 98 in the adjacent shear blades 90, so that each cutter blade functions as a spacer for the two shear blades between which it is mounted.

The overlapping, interleaved arrangement of the recessed-face shear blades 90 and their associated secondary cutter blades 100, relative to comminution chamber 11, is best shown in FIGS. 2 and 3. As shown therein, the shearing and cutting mechanism comprising primary blades 90 and secondary blades 100 essentially fills the comminution chamber, leaving little or no room for any object of appreciable size to pass through the chamber without engaging the shearing/cutting mechanism. The directions of rotation for shafts 50, 60, 70, and 80 are indicated by arrows B, C, D and E in FIG. 3. The direction of rotation for drive gear 54 is indicated by the arrow F and the direction of rotation for drive gear 74 is shown by arrow G.

When the shearing/cutting machine 10 is to be placed in operation, control 29 (FIG. 1) is actuated to energize the two main comminution drive motors 64 and 85 to drive the gear reducers 58 and 78. In consequence, the gears 54 and 74 on the output shafts of the two gear reducers are driven in the directions indicated by the arrows F and G in FIGS. 2 and 3, so that shafts 50, 60, 70 and 80 are rotated in the directions indicated by the arrows B, C, D and E. Control 29 may then be actuated to supply air under pressure to the right-hand end of cylinder 25, driving piston 31 to the left-hand end of the cylinder as seen in FIG. 1. This movement of piston 31 is transmitted to ram 24 through the chain and sprocket drive 32–36, shifting the ram to the upper (right-hand) end of feed chute 21.

Machine 10 is now ready to be loaded with articles 38 to be comminuted. As previously noted, machine 10 is capable of comminuting objects of many diverse materials and widely varying dimensional characteristics. Such objects may include plastic barrels, other plastic containers, scrap and defective moldings from a plastic or elastomer molding operation, plastic films, metal films and other light metal parts, and even rubber tires. The operator opens the hinged safety cover 23 of chute 21 and loads the articles 38 into the chute. Cover 23 is then closed and control 29 is actuated to supply air under pressure to the left-hand end of cylinder 25, driving piston 31 upwardly and to the right through the cylinder. As a consequence, ram 24 is urged in the direction of arrow A, FIG. 1, and drives the articles 38 along chute 21 and into the input opening 19 of comminuting chamber 11.

The articles 38, as they enter the input opening 19 of chamber 11 through the fixed safety hood 22, are first engaged by the primary shear blades 90, and particularly by the cutting elements 94 on the shear blades. The cutting edges 96 of these elements 94 serve a dual purpose; they cut into the articles 38 entering comminution chamber 11 and impel those articles, or at least parts of the articles, into the areas of overlap between the shear blades 90, which extend completely across comminution chamber 11 as is clearly shown in FIG. 2. Thus, the objects 38, as they are forced into the comminution chamber, are sheared and cut at the overlapping junctures of the shear blades of all four of the shafts 50, 60, 70 and 80.

Many materials, particularly plastics and elastomers, when cut by a shearing action such as that provided by the intermeshed shear blades 90, tend to expand immediately after shearing. It is this expansion action that imposes high power requirements on previously known shearing/ cutting comminution machines generally similar to machine 10; the expanding sheared material tends to create high friction between the shearing blades and materially increases the power demand on the main comminution drive. In machine 10, however, the sheared material is almost immediately driven into the recesses 98 in the radial faces 97 of shear blades 90 (see FIGS. 5 and 6) so that frictional drag on the shear blades is effectively minimized. In consequence, the power demands for machine 10 are materially reduced. In effect, the shearing/cutting machine 10 having drive motors 64,85 totalling forty horsepower, in combination with a twenty-five horsepower granulator is able to do the work of a similar combination of machines which, using shear blades lacking recesses 98, would require a total of three hundred horsepower.

The segments of material cut from objects 38 by shear blades 90 may take the form of elongated "streamers" projected into the spaces between adjacent shear blades. Such elongated streamers, however, are cut to shorter lengths by the cutting edges 102 on the secondary cutter blades 100. As a consequence, the comminuted material 43 discharged from chamber 11 through its outlet opening 41 is of a shorter, more acceptable length. This comminuted material is charged onto the takeaway conveyor 42 (FIG. 1).

The secondary cutter blades 100 interposed between the primary shear blades 90 serve another purpose. They effectively clean out particles cut from the objects 38 by shear blades 90 and preclude any excess accumulation of material in the spaces between the shear blades.

For most effective operation, it is desirable that each of the shafts 50, 60, 70 and 80 be rotated at a speed which is different from that of any adjacent shaft. This condition is assured by the variation in the diameters of the spur gears 53, 67,73 and 83 as shown in FIG. 3. In a typical embodiment of shearing/cutting machine 10, in which the rotational speeds of the drive gears 54 and 74 are 50 rpm, the rotational speeds for the comminution shafts may be as follows:

| | |
|---|---|
| Shaft 50 | 60 rpm |
| Shaft 60 | 50 rpm |
| Shaft 70 | 33 rpm |
| Shaft 80 | 60 rpm |

In one commercial embodiment of machine 10, the following dimensional characteristics have been successfully applied:

| | |
|---|---|
| Comminution chamber input opening 19 | 27 × 27 inches |
| Minimum radius Y in shear blades 90, at point 92 | 3.938 inches |
| Maximum radius Z of shear blade 90, at point 93 | 4.5 inches |
| Width W (FIG. 6) of shear blade 90 | 1.454 inches |
| Diameter of recess 98 of shear blade 90 | 7.200 inches |
| Radius X of secondary cutter blade 100 (FIG. 5) | 2.1875 inches |
| Width V of secondary cutter blade 100 (FIG. 6) | 1.824 inches |
| Shear spacing S between adjacent blades 90, FIG. 6 | .06 inch |
| Length of chute 21 | 7 feet to 12 feet |
| Width of chute 21 | 27 inches (inside) |

For this specific machine, the two drive motors 64 and 85 may each comprise a twenty horsepower electrical motor.

The basic controls for machine 10 may be quite simple, being concerned primarily with the energization of the main drive motors 64 and 85 and operation of the rodless cylinder 25 that drives ram 24. Although overloading or jamming of the comminuting mechanism is much less frequent than in previously known machines, there is still a possibility of a jam for some particular combinations of materials and configurations in the articles being comminuted; consequently, it is desirable to include in control 29 some means to monitor the load on the motors and to slow or interrupt the ram drive if an excessive motor load condition is detected. If a jam actually occurs, a zero speed switch, monitoring motors 64 and 85, can be employed to reverse the directions of the two drive motors to clear the machine and subsequently return it to normal operation. A limit switch (not shown) positioned in the path of ram 24 can be employed to stop the machine and signal to the operator that a new load of objects 38 requiring comminution should be put into chute 21.

In machine 10, as described above in connection with FIGS. 1–6, both radial faces of each of the shear blades 90 are provided with recesses 98 to reduce friction in the machine and, concomitantly, improve the shearing action of these blades. However, much of the benefit of the recessed-face construction for the shearing blades can be achieved by recessing only one face of each blade in the manner generally illustrated in FIG. 7. In FIG. 7, which shows only a very limited portion of the comminution mechanism, each of the shafts 50, 60, and 70 is provided, as before, with a series of spaced secondary cutter blades 100 as described above. In this construction, however, the shear blades 190 are modified so that each shear blade has a recess 198 in only one radial face 197. To be effective, this modification should have all of the recesses 198 facing in the same direction so that there is a recessed face on each shear blade immediately adjacent the shearing overlap with a blade on an adjacent shaft. In all other respects, the modification of FIG. 7 may conform to that described above.

Machine 10, as described, is capable of shearing and cutting large objects and articles, virtually anything that will fit through input opening 19 of chamber 11. In a smaller capacity machine, one or both of the two outer shafts might be eliminated. On the other hand, for even greater capacity, additional comminution shafts may be needed. In any multi-shaft machine, an arcuate alignment of the shafts, as shown in FIG. 3, adds to the efficiency of the machine.

In the drawings, the cutting edges 96 and 102 of blades 90 and 100 are shown parallel to the axes of the shafts on which the blades are mounted. This parallel relation need not be maintained in all instances. The cutting edges, though transverse to the disc blades, can be angled relative to the shaft axes.

Machine 10, as described, employs an electric drive for the comminution shafts and a pneumatic drive for ram 24. It will be recognized, however, that other drives may be employed. Thus, an electric motor drive for ram 24 is readily usable; hydraulic drives for the comminution shafts and/or the ram are also quite practical.

I claim:

1. A rotary shearing/cutting machine capable of comminuting articles of widely varying dimensional characteristics formed of a broad variety of different materials, comprising:

a comminution chamber having an input opening and a discharge opening;

feed means for feeding articles to be comminuted into the input opening of the comminution chamber;

a plurality of rotary shafts extending across the comminution chamber in parallel spaced relation to each other;

drive means for rotating each shaft in a given direction; and a series of primary shear blades mounted at spaced locations along each shaft for rotation therewith, each shear blade on one shaft being aligned with and projecting partly into the space between the shear blades on any adjacent shaft in close overlapping proximity thereto;

each shear blade being of generally disc-like configuration and having a C-shaped cutting element projecting radially outwardly therefrom, the cutting element affording a transverse cutting edge facing toward the direction of rotation of the shaft on which the blade is mounted;

at least one radial face of each shear blade being recessed, from a point near the rim of the disc blade for a substantial distance radially inwardly toward the shaft on which the blade is mounted, to afford an annular expansion space for material sheared in a region of overlap between that shear blade and any shear blade on an adjacent shaft.

2. A rotary shearing/cutting machine according to claim 1 in which both radial faces of each shear blade are recessed to afford annular expansion spaces on both sides of the blade.

3. A rotary shearing/cutting machine according to claim 1 and further comprising:

a series of secondary cutter blades mounted at spaced locations along each shaft for rotation therewith, each cutter blade interposed between two adjacent shear blades on the shaft;

each cutter blade being of generally disc-like configuration and having at least one C-shaped cutting element projecting radially outwardly therefrom, affording a transverse cutting edge facing in the direction of rotation of the shaft on which the cutter blade is mounted.

4. A rotary shearing/cutting machine according to claim 2 and further comprising:

a series of secondary cutter blades mounted at spaced locations along each shaft for rotation therewith, each cutter blade interposed between two adjacent shear blades on the shaft;

each cutter blade being of generally disc-like configuration and having at least one C-shaped cutting element projecting radially outwardly therefrom, affording a transverse cutting edge facing in the direction of rotation of the shaft on which the cutter blade is mounted.

5. A rotary shearing/cutting machine according to claim 3 or claim 4, in which:

the comminution chamber is oriented so that the input opening is in a generally vertical plane; and the feed means comprises a substantially horizontal chute having one end aligned with the input opening and a power driven ram for forcing articles along the chute into the input opening.

6. A rotary shearing/cutting machine according to claim 5 in which the plane of the comminution chamber input opening is aligned at an acute angle to the vertical and the chute is aligned at an acute angle to the horizontal, the end of the chute farthest from the input opening being elevated above the bottom of the input opening.

7. A rotary shearing/cutting machine according to claim 1, or claim 2, or claim 3, or claim 4, including four shafts having their axes in an arcuate array with the central shaft axes displaced farther from the input opening than the outer shaft axes.

8. A rotary shearing/cutting maching according to claim 7 in which the drive means rotates each shaft at a speed different from any adjacent shaft, with two central shafts rotating in opposite directions and two outer shafts each rotating in the same direction as the adjacent central shaft.

9. A rotary shearing/cutting machine according to claim 5, including four shafts having their axes in an arcuate array with the central shaft axes displaced farther from the input opening than the outer shaft axes.

10. A rotary shearing/cutting machine according to claim 9 in which the drive means rotates each shaft at a speed different from any adjacent shaft, with two central shafts rotating in opposite directions and two outer shafts each rotating in the same direction as the adjacent central shaft.

* * * * *